US011048187B1

(12) United States Patent
Arai

(10) Patent No.: US 11,048,187 B1
(45) Date of Patent: Jun. 29, 2021

(54) EXPOSURE CONTROL DEVICE, IMAGE FORMING APPARATUS, AND NON-TRANSITORY COMPUTER READABLE MEDIUM

(71) Applicant: FUJIFILM BUSINESS INNOVATION CORP., Tokyo (JP)

(72) Inventor: Shigeru Arai, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/985,355

(22) Filed: Aug. 5, 2020

(30) Foreign Application Priority Data

Mar. 16, 2020 (JP) ..... JP2020-045015

(51) Int. Cl.
*G03G 15/043* (2006.01)
*G03G 15/00* (2006.01)
*G03G 15/04* (2006.01)
*G03G 15/01* (2006.01)

(52) U.S. Cl.
CPC ..... *G03G 15/043* (2013.01); *G03G 15/011* (2013.01); *G03G 15/04045* (2013.01); *G03G 15/5058* (2013.01); *G03G 2215/00059* (2013.01)

(58) Field of Classification Search
CPC ..... G03G 15/011; G03G 15/04045; G03G 15/043; G03G 15/5058; G03G 2215/00059
See application file for complete search history.

(56) References Cited

U.S. PATENT DOCUMENTS 8,508,800 B2 * 8/2013 Abe ..... H04N 1/506 358/1.9
2012/0288291 A1 * 11/2012 Miyadera ..... G03G 15/043 399/51

FOREIGN PATENT DOCUMENTS

JP 5825862 B2 12/2015

* cited by examiner

*Primary Examiner* — Hoang X Ngo
(74) *Attorney, Agent, or Firm* — Oliff PLC

(57) ABSTRACT

An exposure control device includes an exposure light amount calculator that obtains, for each of correction points that are associated with a respective one of primary correction values and are separated from each other, a correction factor for correcting the primary correction value of the correction point, based on a pixel value of the correction point, calculates, for each correction point, a secondary correction value based on the primary correction value and the correction factor of the correction point, and calculates a distribution of the secondary correction values on an image based on the secondary correction values of the correction points, and an exposure controller that causes an exposure unit to form a latent image by exposure to light having a corrected light amount obtained by correcting a light amount corresponding to a pixel value of each point based on the secondary correction value of the point.

16 Claims, 11 Drawing Sheets

FIG. 10

| | 212 LPI 45 DEGREES | 190 LPI 45 DEGREES | 205 LPI 20/70 DEGREES | 185 LPI 12/67 DEGREES |
|---|---|---|---|---|
| 16 LINES | 25% : 1% (±0.5%)<br>80% : ≒ 0% | 25% : 5% (±2.5%)<br>80% : 2% (±1%) | 25% : 1% (±0.5%)<br>80% : ≒ 0% | 25% : 1% (±0.5%)<br>80% : ≒ 0% |
| 17 LINES | 25% : 2% (±1%)<br>80% : 2% (±1%) | 25% : 2% (±1%)<br>80% : 2% (±1%) | 25% : 1% (±0.5%)<br>80% : ≒ 0% | 25% : 1% (±0.5%)<br>80% : ≒ 0% |
| 18 LINES | 25% : 3% (±1.5%)<br>80% : 4% (±2%) | 25% : ≒ 0%<br>80% : ≒ 0% | 25% : 1% (±0.5%)<br>80% : ≒ 0% | 25% : 1% (±0.5%)<br>80% : ≒ 0% |

EXPOSURE CONTROL DEVICE, IMAGE FORMING APPARATUS, AND NON-TRANSITORY COMPUTER READABLE MEDIUM

CROSS-REFERENCE TO RELATED APPLICATIONS

This application is based on and claims priority under 35 USC 119 from Japanese Patent Application No. 2020-045015 filed Mar. 16, 2020.

BACKGROUND

1. Technical Field

The present disclosure relates to an exposure control device, an image forming apparatus, and a non-transitory computer readable medium.

2. Related Art

When an image is formed, density nonuniformity may occur due to, for example, eccentricity of a developing roller or a difference in a developing ability between a center and an end portion of the developing roller in an axial direction. It has been studied how to correct such density nonuniformity so as to form a good image without the density nonuniformity.

Japanese Patent No. 5825862 discloses that density nonuniformity is prevented by calculating correction pixel values according to pixel values and forming an image using the calculated correction pixel values (corrected image data).

SUMMARY

The pixel value is represented by a digital value within a certain range such as 0 to 255. Therefore, when the pixel value is close to 0, that is, a density is low, even if the pixel value is different by 1, the density is greatly different, and there is a risk of overcorrection. When the pixel value is close to 255, that is, the density is high, since the pixel value cannot be corrected to 255 or more, the correction may be insufficient.

Aspects of non-limiting embodiments of the present disclosure relate to an exposure control device, an image forming apparatus, and a non-transitory computer readable medium that improve accuracy of correction as compared with a case of correcting pixel values.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an exposure control device includes an exposure light amount calculator and an exposure controller. The exposure light amount calculator is configured to obtain, for each of plural correction points that are associated with a respective one of primary correction values and are separated from each other, a correction factor for correcting the primary correction value of the correction point, based on a pixel value of the correction point, calculate, for each correction point, a secondary correction value based on the primary correction value and the correction factor of the correction point, and calculate a distribution of the secondary correction values on an image based on the plural secondary correction values of the plural correction points. The exposure controller is configured to cause an exposure unit to form a latent image by exposure to light having a corrected light amount obtained by correcting a light amount corresponding to a pixel value of each point based on the secondary correction value of the point.

BRIEF DESCRIPTION OF THE DRAWINGS

Exemplary embodiment(s) of the present disclosure will be described in detail based on the following figures, wherein:

FIG. 10 is a diagram illustrating estimation errors of Cin relating to types of the screen and widths of a region in a process direction.

DETAILED DESCRIPTION

Hereinafter, exemplary embodiments of the present disclosure will be described.

Figure 1:
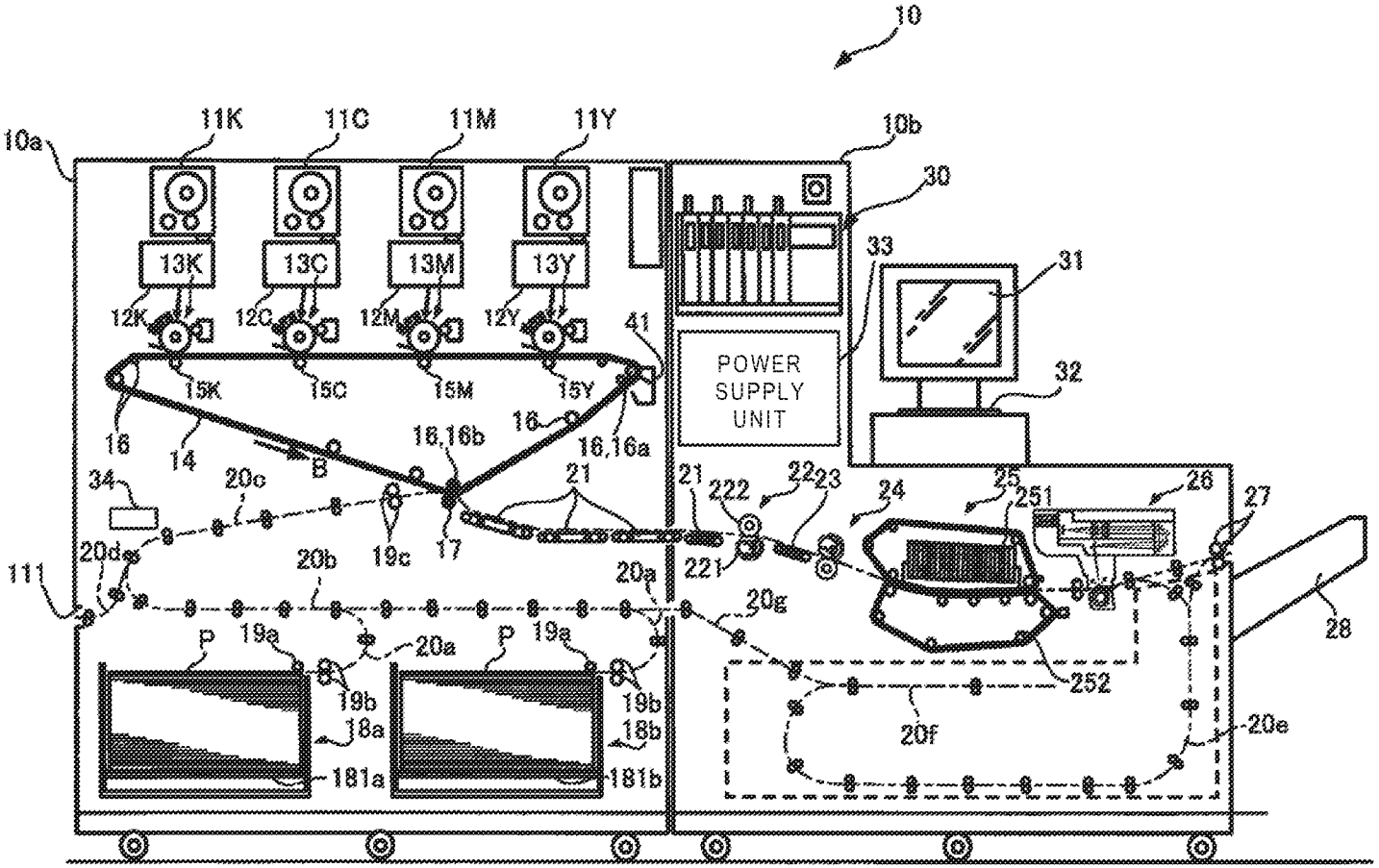
FIG. 1 is a schematic configuration diagram illustrating an image forming apparatus according to an exemplary embodiment of the present disclosure.

FIG. 1 is a schematic configuration diagram illustrating an image forming apparatus 10 according to an exemplary embodiment of the present disclosure. The image forming apparatus 10 includes an exposure control device and an exposure control program according to the exemplary embodiment of the present disclosure.

The image forming apparatus 10 receives image data from a personal computer (which is not illustrated, and is hereinafter abbreviated as a "PC") and forms an image on a sheet based on the image data.

The image forming apparatus 10 includes two housings of a first housing 10*a* and a second housing 10*b* that are connected to each other. Respective members that constitute the image forming apparatus 10 are separately provided in the two housings 10*a* and 10*b*.

The image forming apparatus 10 is configured to form an image using toners of four colors. Four toner cartridges 11Y, 11M, 11C, and 11K that accommodate the toners of the respective colors are arranged in an upper portion of the first housing 10*a*.

Herein, alphabets in reference numerals represent the colors of the toners accommodated in the toner cartridges. Among the alphabets, Y represents yellow, M represents magenta, C represents cyan, and K represents black.

Hereinafter, when it is not necessary to distinguish the colors, the alphabets indicating the colors may be omitted, and the reference numeral "11" is simply assigned to the toner cartridges. When it is necessary to distinguish the colors, the reference numerals each followed by a respective one of the above-described alphabets representing the colors will be used. The same applies to elements other than the toner cartridges 11.

The toner in each toner cartridge 11 is supplied to a developing unit 133 that constitutes an image forming unit 13 (which will be described later). Each toner cartridge 11 is replaceable. When the toner cartridge 11 becomes empty, the toner cartridge 11 is replaced with a new toner cartridge 11 accommodating the toner of the same color.

In the first housing 10*a*, four exposure units 12 and four image forming units 13 are provided below the toner cartridges 11.

Figure 2:
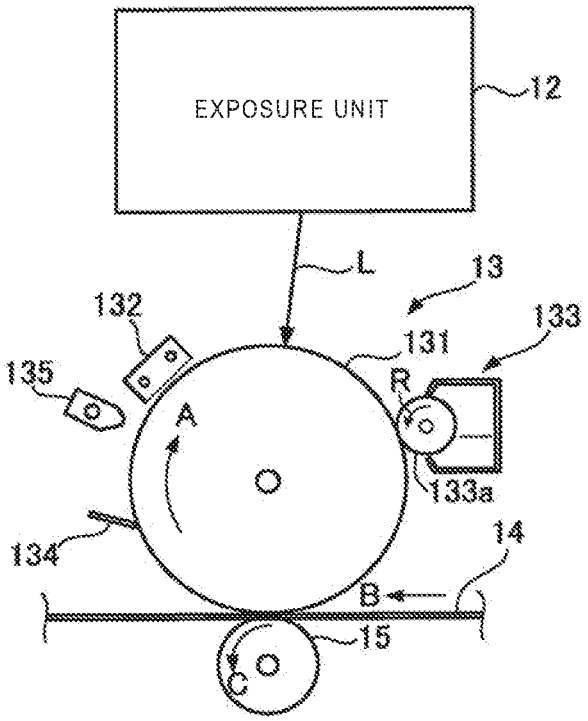
FIG. 2 is a schematic diagram illustrating a configuration around an image forming unit.

FIG. 2 is a schematic diagram illustrating a configuration around one image forming unit 13.

The image forming unit 13 includes a drum-shaped image carrier 131 that rotates in a direction of an arrow A. A charging unit 132, the developing unit 133, a cleaning blade 134, and a static eliminator 135 are disposed around the image carrier 131. The exposure unit 12 is disposed above the image carrier 131. A primary transfer roller 15 is disposed at a position where an intermediate transfer belt 14 (which will be described later) is sandwiched between the image carrier 131 and the primary transfer roller 15.

The image carrier 131 is charged by the charging unit 132 while rotating in the direction of the arrow A.

The exposure unit 12 repeatedly scans the image carrier 131 with an exposure beam L (which is modulated according to the image data) in a direction perpendicular to a paper surface of FIG. 2. The exposure unit 12 forms an electrostatic latent image on the image carrier 131 by repeatedly scanning with the exposure beam L.

A developer containing the toner and a carrier is accommodated in the developing unit 133. The developing unit 133 includes a developing roller 133*a*. The developing roller 133*a* carries the developer accommodated in the developing unit 133 to a position where the developing roller 133*a* faces the image carrier 131, while rotating in a direction of an arrow R. The developing roller 133*a* develops the electrostatic latent image on the image carrier 131 with the toner in the developer to form a toner image on the image carrier 131. The toner is supplied from the corresponding toner cartridge 11 (see FIG. 1) such that a predetermined amount of the toner is accommodated in the developing unit 133.

The toner image formed on the image carrier 131 by an action of the developing unit 133 is transferred onto the intermediate transfer belt 14 that moves in a direction of an arrow B by an action of the primary transfer roller 15 that rotates in a direction of an arrow C while receiving application of a transfer bias.

The toner remaining on the image carrier 131 after the transfer is scraped and collected from the image carrier 131 by the cleaning blade 134. Then, the image carrier 131 is neutralized by the static eliminator 135 to erase the latent image remaining therein, and is newly charged by the charging unit 132.

Returning to FIG. 1, the description will be continued.

Below the four image forming units 13, the endless intermediate transfer belt 14 is provided. The intermediate transfer belt 14 is supported by plural rollers 16 including a driving roller 16*a* and a backup roller 16*b*. The intermediate transfer belt 14 circularly moves in the direction of the arrow B while being in contact with the image carriers 131 that constitute the image forming unit 13.

A secondary transfer roller 17 is provided at a position where the secondary transfer roller 17 faces the backup roller 16*b* with the intermediate transfer belt 14 sandwiched therebetween. The toner images sequentially transferred to the intermediate transfer belt 14 in a superimposed manner by the action of the primary transfer rollers 15 provided corresponding to the respective image forming units 13 are further transported by the intermediate transfer belt 14 in the direction of the arrow B. Then, the toner images on the intermediate transfer belt 14 are secondarily transferred by an action of the secondary transfer roller 17 onto a sheet transported to a position sandwiched between the intermediate transfer belt 14 and the secondary transfer roller 17. Accordingly, an unfixed toner image is formed on the sheet.

Two sheet accommodating units 18*a* and 18*b* are provided in a lower portion of the first housing 10*a*. A large number of sheets P are accommodated in each sheet accommodating units 18*a* and 18*b* in a stacked state. The paper P is taken out from the sheet accommodating units 18*a* and 18*b* during image formation. Bottom plates 181*a* and 181*b* rise as the number of sheets P accommodated in the sheet accommodating units 18*a* and 18*b* decreases.

When the image is formed, the uppermost sheet among the sheets P accommodated in one of the sheet accommodating units 18*a* and 18*b*, which is designated automatically or manually by an operator, is taken out by a pickup roller 19*a*. When the plural sheets P are taken out at once, a retard roller 19*b* reliably separates one sheet from the plural sheets P. Then, the one sheet is transported by a transport roller 19 onto transport paths 20*a*, 20*b*, and 20*c*, and a leading end of the transported sheet reaches a registration roller 19*c*. The first housing 10*a* is provided with an intake port 111 through which the sheet is taken in from the outside of the first housing 10*a*. When the paper is taken in from the intake port 111, the taken-in sheet is transported on the transport paths 20*d* and 20*c*, and a leading end of the sheet reaches the registration roller 19*c*. The registration roller 19*c* corrects a posture of the transported sheet, adjusts subsequent timing at which the sheet is fed, and further feeds the sheet downstream in a transport direction.

The registration roller 19*c* feeds the sheet such that the sheet is transported to a position of the secondary transfer roller 17 at the same timing as the toner image on the intermediate transfer belt 14 is transported to the position of the secondary transfer roller 17.

The sheet on which the toner image is transferred by the action of the secondary transfer roller 17 is transported by a transport belt 21, enters the second housing 10*b*, and reaches a fixing unit 22. The fixing unit 22 includes a heating belt 221 and a pressure roller 222. The sheet transported to the fixing unit 22 is heated and pressed while being sandwiched between the heating belt 221 and the pressure roller 222, so that the toner image on the sheet is fixed on the sheet. The sheet that has passed through the fixing unit 22 is transported by a transport belt 23, and reaches a decurler 24. A warp of the sheet is corrected by the decurler 24.

The sheet that has passed through the decurler 24 is cooled by a cooling unit 25. The cooling unit 25 cools the sheet by sandwiching the sheet between two endless belts 251 and 252. An optical measuring unit 26 measures an image (that is, the fixed toner image) on the sheet discharged from the cooling unit 25. The optical measuring unit 26 monitors whether the image is correctly formed on the sheet during normal image formation. During adjustment, the optical measuring unit 26 performs measurement for the adjustment, for example, in the following manners. That is, (i) the image forming apparatus 10 arranges various charts and color patches on a sheet, and the optical measuring unit 26 measures the charts and color patches for color tone adjustment, or (ii) the image forming apparatus 10 forms an image for adjustment of an image formation position or image magnification on a sheet, and the optical measuring unit 26 measures this image to adjust the image formation position or the image magnification. Furthermore, the image forming apparatus 10 forms an image having a uniform color and a uniform density on a sheet, and the optical measuring unit 26 measures the image to check if scratch or density unevenness is generated on the image.

The sheet that has passed through the optical measuring unit 26 is discharged onto a sheet discharge table 28 by a discharge roller 27.

After the toner image is secondarily transferred onto the sheet by the action of the secondary transfer roller 17, the intermediate transfer belt 14 still moves in the direction of the arrow B and reaches a cleaner 41. The cleaner 41 removes the toner remaining on the intermediate transfer belt 14 from the intermediate transfer belt 14.

A process of forming an image only on a first surface of the sheet has been described above. A process of forming images on both surfaces of the sheet will be described below. In this case, the image is formed on the first surface of the sheet by the same process as above, and then the sheet passes through the optical measuring unit 26. The sheet that has passed through the optical measuring unit 26 enters a transport path 20*e* before reaching the discharge roller 27, is transported on the transport path 20*e* and further enters a transport path 20*f*. When the sheet enters the transport path 20*f*, rotation directions of transport rollers that constitute the transport path 20*f* reverse, and the sheet is fed out in an opposite direction from the transport path 20*f*, returns to the first housing 10*a*, is transported on the transport paths 20*b* and 20*c*, and reaches the registration roller 19*c*. At this time, the sheet is in a posture in which a second surface on which the image has not yet been formed faces the intermediate transfer belt 14. By the time the sheet reaches the registration roller 19*c* through such a transport path, the image forming unit 13 forms toner images corresponding to an image to be formed on the second surface of the sheet and transfers the toner images onto the intermediate transfer belt 14. Thereafter, similar to the manner in which the image is formed on the first surface of the sheet, the sheet is fed out from the registration roller 19*c*, and the toner images are transferred to the second surface of the sheet by the action of the secondary transfer roller 17, and then the sheet passes through the fixing unit 22, the decurler 24, the cooling unit 25, and the optical measuring unit 26, and is then discharged onto the sheet discharge table 28 by the discharge roller 27.

An image processor and controller 30 is provided in an upper part of the second housing 10*b* of the image forming apparatus 10. The image processor and controller 30 includes a memory, an operating circuit, and a control circuit. The memory stores the image data and the like sent from the outside. The operating circuit performs various processing, such as image processing, for the image data. The control circuit controls the overall image forming apparatus 10. The image processor and controller 30 has an operating function of executing a program. The operating circuit and the control circuit that constitute the image processor and controller 30 provide functions implemented by a combination of hardware of the image processor and controller 30 and the program executed by the image processor and controller 30.

A power supply unit 33 is provided below the image processor and controller 30. The power supply unit 33 supplies necessary power to each member of the image forming apparatus 10.

The image forming apparatus 10 includes an environment sensor 34 that measures environmental temperature and humidity inside the image forming apparatus 10. The temperature and humidity measured by the environment sensor 34 are reported to the image processor and controller 30 and are reflected in various control of the image forming apparatus 10.

A monitor 31 and an operation panel 32 are placed on a lower step of the second housing 10*b*. The monitor 31 displays various statuses of the image forming apparatus 10. The operation panel 32 is operated by an operator.

The overall image forming apparatus has been described above. Hereinafter, description will be made on exposure control that is a feature of the present exemplary embodiment, that is, light amount control of the exposure beam L emitted from the exposure unit 12.

Figure 3:
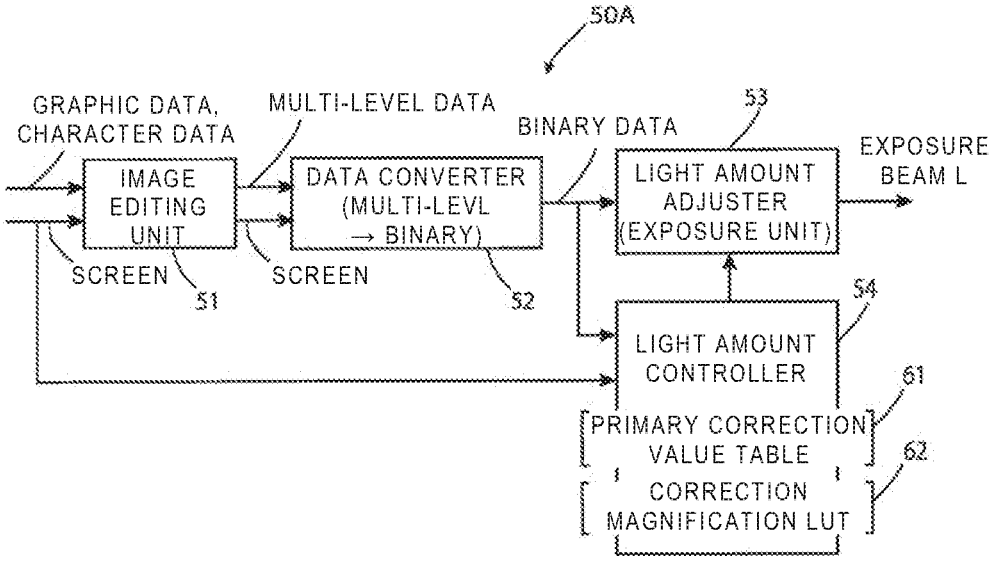
FIG. 3 is a block diagram illustrating a configuration of an exposure control device according to a first exemplary embodiment of the present disclosure.

FIG. 3 is a block diagram illustrating a configuration of an exposure control device 50A according to a first exemplary embodiment of the present disclosure.

FIG. 1 illustrates the image forming apparatus 10 that forms a color image using the toners of the four colors of Y, M, C, and K. Description which will be made with reference to FIG. 3 and subsequent drawings is common to those four colors. Thus, one color will be illustrated and described below.

Except for a light amount adjuster 53, the exposure control device 50A is established in the image processor and controller 30 illustrated in FIG. 1 by the image processor and controller 30 executing the exposure control program. The light amount adjuster 53 is provided in the exposure unit 12.

The exposure control device 50A includes an image editing unit 51, a data converter 52, the light amount adjuster 53, and a light amount controller 54. Herein, the light amount controller 54 includes a primary correction value table 61 and a correction magnification lookup table (LUT) 62.

The image data transmitted from the external PC is input to the image editing unit 51. The image data includes (i) information indicating components on data that constitutes an image, such as graphic data and character data, and (ii) information indicating a type of a screen for halftone dot printing. The image editing unit 51 generates multi-level data of each of pixels constituting the image by integrating the input data in various formats. The multi-level data of each pixel has a numerical value of in a range of 0 to 255. In a screen image (halftone dot image), a pixel value of 0 refers to a dot percent of 0%, and a pixel value of 255 refers to a dot percent of 100%. Other numerical values are also similar.

The multi-level data generated in the image editing unit 51 is input to the data converter 52. Information on the screen is also passed to the data converter 52. The data converter 52 converts the multi-level data received from the image editing unit 51 into binary data representing a screen image (halftone dot image) according to an instructed screen. Two values of the binary data will be described as white and black for the sake of understanding. It is noted that this notation is used on data, but an actual color is not white or black. The actual color is different for each of the toners of the four colors.

The binary data is data representing a pixel of multi-level data using a screen image (halftone dot image) having a set of white and black dots. For example, when a certain pixel has a dot percent of 50% that is a central value of 127 in the multi-level data from 0 to 255, the pixel is represented by half white dots and half black dots that are arranged according to a designated screen. The same applies to the multi-level data of other values. Herein, the white dots on the image refer to dots that are not irradiated with the exposure beam L, and the black dots refer to dots that are irradiated with the exposure beam L.

The binary data generated in the data converter 52 is input to the light amount adjuster 53. The binary data is also input to the light amount controller 54. Description on the light amount controller 54 will be given later.

The light amount adjuster 53 is provided in the exposure unit 12 illustrated in FIGS. 1 and 2. The light amount adjuster 53 converts the received binary data into ON and OFF of the exposure beam L. That is, the light amount adjuster 53 turns off the exposure beam L for dots that represent white in the binary data, so as not to emit the light beam L, and the light amount adjuster 53 turns on the exposure beam L for dots that represent black in the binary data, so as to emit the light beam L to the image carrier 131. It is noted that the light amount of the exposure beam L that is turned on for each of the dots representing black is adjusted based on an instruction from the light amount controller 54.

The information on the screen and the binary data are input to the light amount controller 54. In the first exemplary embodiment illustrated in FIG. 3, the image editing unit 51 and the data converter 52 are integrally configured, and the multi-level data cannot be taken out therefrom.

Figure 11:
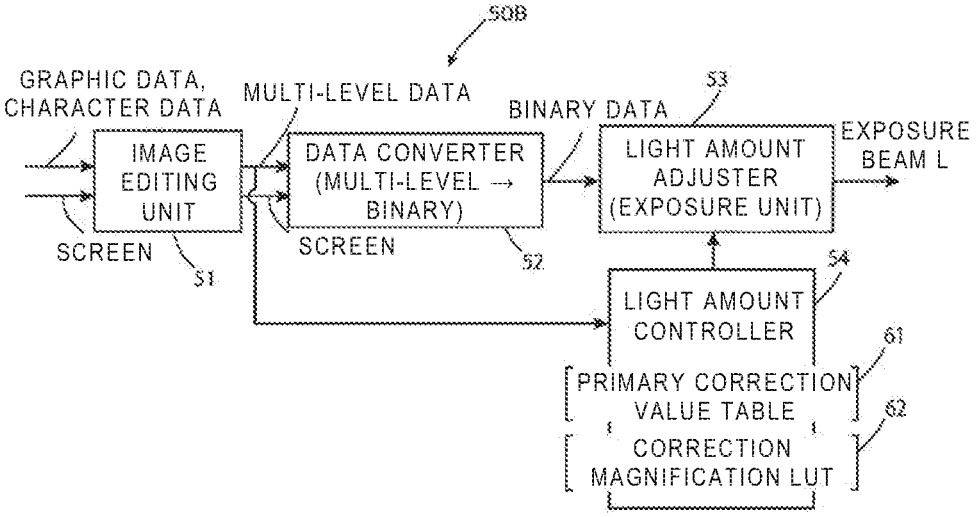
FIG. 11 is a block diagram illustrating a configuration of an exposure control device according to a second exemplary embodiment of the present disclosure.

In an exposure control device 50B according to a second exemplary embodiment illustrated in FIG. 11, the image editing unit 51 and the data converter 52 are separated, and the multi-level data can be taken out. Therefore, in the second exemplary embodiment, the multi-level data is input to the light amount controller 54, and both of the screen data and the binary data are unnecessary. The second exemplary embodiment will be described later. Herein, the description on the exposure control device 50A of the first exemplary embodiment illustrated in FIG. 3 will be continued.

The light amount controller 54 includes the primary correction value table 61 and the correction magnification LUT 62. The primary correction value table 61 and the correction magnification LUT 62 are created in advance and installed in the light amount controller 54.

First, the primary correction value table 61 and the correction magnification LUT 62 will be described.

Figure 4:
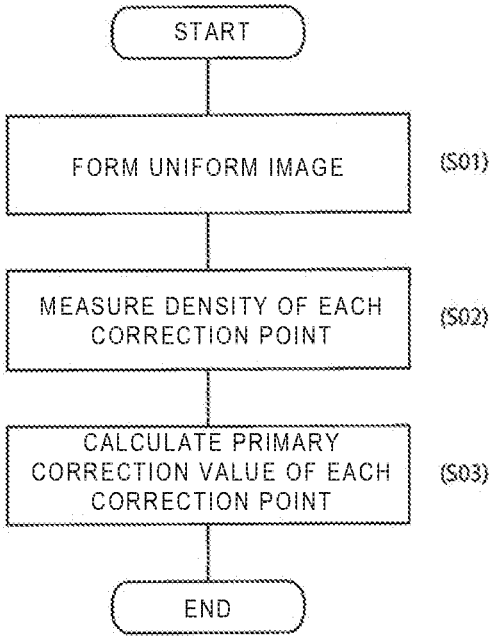
FIG. 4 is a diagram illustrating a flowchart of a procedure of creating a primary correction value table.

FIG. 4 is a diagram illustrating a flowchart of a procedure of creating the primary correction value table 61.

The primary correction value table 61 is created for each image forming apparatus 10 at a preparatory stage before use of the image forming apparatus 10 starts or before factory shipment.

Herein, first, a uniform image, for example, an image having a dot percent of 60% is formed on a sheet (step S01), and a density of each correction point is measured by the optical measuring unit 26 (step S02).

Figure 5:
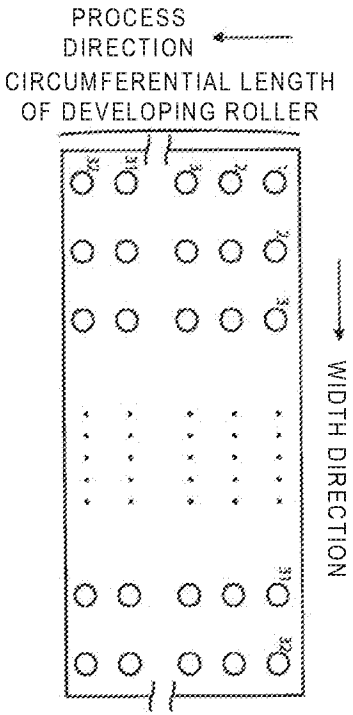
FIG. 5 is a diagram illustrating correction points.

FIG. 5 is a diagram illustrating the correction points.

Herein, as an example, thirty two (32) correction points are arranged at equal intervals within a length of one cycle of the developing roller 133*a* (see FIG. 2) in a process direction (sheet transport direction) on the sheet. This configuration is adopted in order to consider correction of density nonuniformity caused by nonuniform rotation of the developing roller 133*a*. In the example illustrated here, thirty two (32) correction points are also arranged at equal intervals in a width direction intersecting the process direction within an entire width of the sheet. In step S02 of FIG. 4, the densities of the 32×32 correction points are measured by the optical measuring unit 26.

In the image forming apparatus 10 illustrated in FIG. 1, the optical measuring unit 26 that measures the density of the image on the sheet is provided. Therefore, the uniform image is formed on the sheet and the densities are measured by the optical measuring unit 26. Alternatively, the densities may be measured by a measuring unit separate from the image forming apparatus 10. The uniform image may be, for example, a toner image directly formed on the intermediate transfer belt 14. It is not necessary that the uniform image is an image formed on the sheet. In this case, it is necessary to use the measuring unit according to a place where the uniform image is formed, for example, a measuring unit that measures a density of the uniform toner image directly formed on the intermediate transfer belt 14.

Returning to FIG. 4, the description will be continued.

In step S03 of FIG. 4, a primary correction value of each correction point is calculated.

Figure 6:
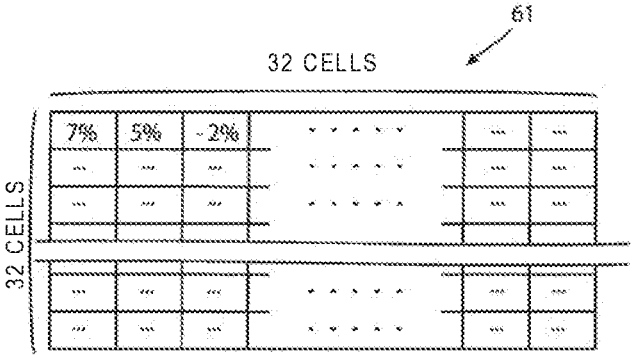
FIG. 6 is a diagram illustrating an example of the primary correction value table.

FIG. 6 is a diagram illustrating an example of the primary correction value table 61.

The primary correction value table 61 is a table having 32 columns by 32 rows. Each cell corresponds to a respective one of the correction points. In each cell, the primary correction value of the corresponding one of the correction points is written.

Herein, the uniform image having the dot percent of 60% is formed, and the density of each correction point is measured. Therefore, each correction point has an expected value of the density corresponding to the dot percent of 60%. A pixel value measured at each correction point is ideally a pixel value representing the density as expected, but does not always match the expected value due to various error factors. The primary correction value in each cell of the primary correction value table 61 illustrated in FIG. 6 represents a difference between the pixel value measured at the corresponding correction point and the expected value. For example, 7% in a cell at an upper left corner refers to that a pixel value measured at a correction point corresponding to that cell is smaller than the expected value of the cell and if the density is increased by 7%, the pixel value becomes the expected value. Similarly, 5% in a cell to the right of the cell at the upper left corner and −2% in a cell to the right of the cell having 5% respectively refer to that if the density is increased by 5%, the pixel value becomes the expected value and that if the density is decreased by 2%, the pixel value becomes the expected value. The same applies to the primary correction values in the other cells. For the purpose of simplification of the figure, the numerical values in the other cells are omitted.

The primary correction value table 61 created in this way is installed in the light amount controller 54 illustrated in FIG. 3.

Figure 7:
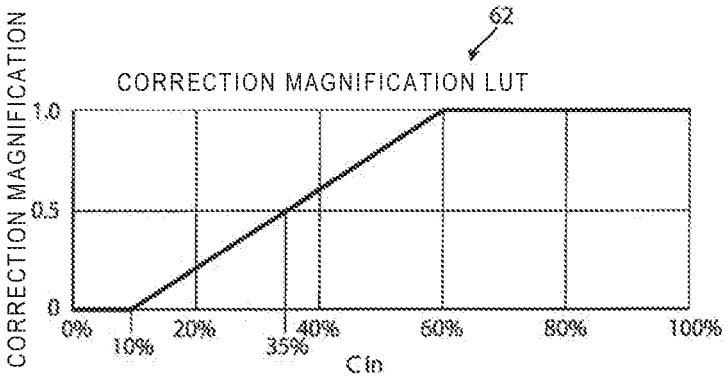
FIG. 7 is a diagram illustrating an example of a correction magnification lookup table (LUT)

FIG. 7 is a diagram illustrating an example of the correction magnification LUT 62.

In FIG. 7, a horizontal axis represents multi-level data Cin (%) of each pixel represented in dot percent, and a vertical axis represents a correction magnification. The correction magnification LUT 62 is determined for each model of the image forming apparatus 10 or by a large number of experiments for plural models. Similar to the primary correction value table 61 illustrated in FIG. 6, the correction magnification LUT 62 is also installed in the light amount controller 54.

Figure 8:
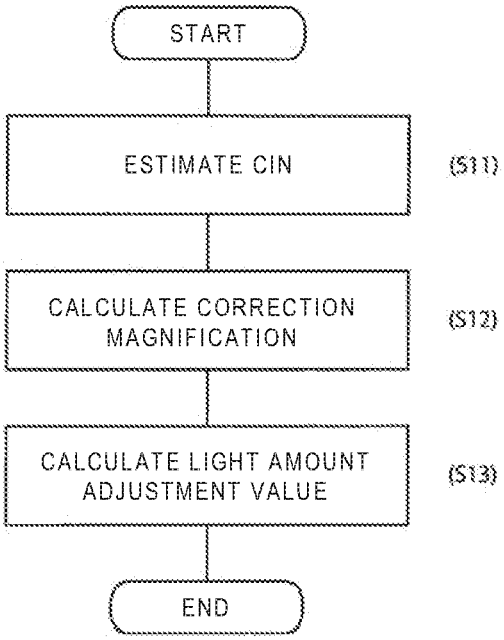
FIG. 8 is a diagram illustrating a flowchart of a process executed on a light amount controller of the exposure control device illustrated in FIG. 3 when a user image is formed.

FIG. 8 is a diagram illustrating a flowchart of a process executed on the light amount controller 54 of the exposure control device 50A illustrated in FIG. 3 when a user image is formed.

As described above, in the exposure control device 50A of the first exemplary embodiment illustrated in FIG. 3, it is not possible to obtain the multi-level data representing Cin. Therefore, the exposure control device 50A estimates Cin (step S11). An arithmetic operation of estimating Cin in step S11 will be described later. The description will be given with the assumption that Cin is already estimated.

The light amount controller 54 calculates the correction magnification based on the estimated Cin with reference to the correction magnification LUT 62 (step S12). The light amount controller 54 reads the primary correction value with reference to the primary correction value table 61, and multiplies the read primary correction value by the calculated correction magnification to calculate a light amount adjustment value (step S13). The calculated light amount adjustment value is an example of a secondary correction value according to the present disclosure. The light amount controller 54 outputs the calculated light amount adjustment value to the light amount adjuster 53.

The light amount adjuster 53 adjusts the light amount of the exposure beam L for each pixel according to the input light amount adjustment value. The image carrier 131 is exposed with the exposure beam L whose light amount is adjusted.

A method of calculating the correction magnification and a method of calculating the light amount adjustment value will be described.

The correction magnification LUT 62 illustrated in FIG. 7 monotonically increases with respect to Cin (%) and has a correction magnification of 1.0 at a predetermined value (in this example, Cin=60%) or more.

It is assumed that the pixel value of the pixel overlapping the correction point at the upper left corner in FIG. 5 is Cin=60% or a larger value larger than 60% when an actual user image is formed instead of forming the uniform image described above. At this time, for the pixel overlapping the correction point, the light amount of the exposure beam L is increased by 7% that is in the cell at the upper left corner of the primary correction value table 61 illustrated in FIG. 6 from a predetermined reference light amount. When the pixel value of the pixel overlapping the correction point at the upper left corner in FIG. 5 is Cin=35%, 7% is multiplied by a correction magnification of 0.5 read from the correction magnification LUT 62 in FIG. 7, and the light amount of the exposure beam L is larger by 7%×0.5=3.5% than the reference light amount, instead of 7%. When the pixel value of the pixel overlapping the correction point at the upper left corner in FIG. 5 is Cin=10% or a value less than 10%, 7% is multiplied by a correction magnification of 0.0 read from the correction magnification LUT 62 in FIG. 7, and the light amount of the exposure beam L is increased by 0% (=7%×0.0) instead of 7%, that is, the exposure beam L having a light amount of the reference light amount is adopted.

It is assumed that Cin at a correction point that is to the right of the correction point at the upper left corner in FIG. 5 has Cin=35% at in forming the user image. At this time, similar to the above, a primary correction value 5% of the corresponding correction point in FIG. 6 is multiplied by the correction magnification of 0.5 read from the correction magnification LUT 62 in FIG. 7, and an exposure beam L having a light amount that is larger by 5%×0.5=2.5% than the reference light amount is adopted.

Similarly, it is assumed that a correction point that is second to the right of the correction point at the upper left corner has Cin=35% in forming the user image. At this time, similar to the above, a primary correction value −2% at the corresponding correction point in FIG. 6 is multiplied by the correction magnification of 0.5 read from the correction magnification LUT 62 in FIG. 7, and an exposure beam L having a light amount that is smaller by 2%×0.5=1% than the reference light amount, that is, a light amount obtained by decreasing the reference light amount by 1% is adopted.

The light amount of the exposure beam L is adjusted for the pixel overlapping each correction point as described above.

Next, a method of adjusting a light amount of the exposure beam L for a pixel between two adjacent correction points will be described.

It is assumed that a light amount correction value relating to the pixel overlapping the correction point at the upper left corner in FIG. 5 is 5%, and a light amount correction value relating to the pixel overlapping the correction point to the right of the pixel overlapping the correction point at the upper left corner is 2%, both of which are calculated based on the above-mentioned calculation method. At this time, for a pixel existing between the two pixels overlapping the two correction points, a light amount correction value is obtained by performing linear interpolation on 5% and 2%. That is, for the pixel in a center of the two pixels overlapping the two correction points, a light amount correction value (5%+2%)/2=3.5% is adopted. For a pixel at a position where a distance to the pixel whose light amount correction value is 5% and a distance to the pixel whose light amount correction value is 2% is 1:2, a light amount correction value (5%×2+2%)/3=4% is adopted. The same applies to pixels at the other positions. The pixels arranged in the width direction are described here. The same applies to pixels arranged in the process direction.

For a pixel at a position shifted from the correction points in both the width direction and the process direction, a light amount correction value is obtained by two-dimensional linear interpolation on the light amount correction values of four pixels overlapping four surrounding correction points. An algorithm of the two-dimensional linear interpolation has been well known, and the description thereof is omitted here. In the above description, the linear interpolation is adopted. It is noted that the linear interpolation does not have to be adopted. A higher-order interpolation may be adopted.

The uniform image described with reference to FIG. 4 is a uniform image of Cin 60% for which the correction magnification LUT 62 is 1.0. That is, the uniform image is a uniform image of Cin for which the primary correction values illustrated in the primary correction value table 61 of FIG. 6 and the light amount correction values calculated as described above are the same. It is assumed that the uniform image described with reference to FIG. 4 is, for example, a uniform image of Cin=35%. In this case, the primary correction value is calculated in a similar manner. However, in this case, as a correction magnification LUT having effect equivalent to that of the correction magnification LUT 62 illustrated in FIG. 7, a correction magnification LUT in which a correction magnification is 2.0 when the pixel value of the user image is, for example, Cin=60% is created. Theoretically, (i) a case where a uniform image of Cin=60% or a value larger than 60% is formed and a correction magnification LUT in which the correction magnification is 1.0 at most is created and (ii) a case where a uniform image of a low Cin is created and a correction magnification LUT in which a correction magnification exceeding 1.0 appears is created are equivalent to each other with errors ignored. However, when the correction magnification exceeding 1.0 appears, an error is greatly amplified. The density nonuniformity of the image may be amplified without being corrected correctly. Therefore, in the exemplary embodiment, a uniform image of Cin=60% is created such that the correction magnification is at most 1.0.

Next, a method of estimating Cin in step S11 of FIG. 8 will be described.

Herein, Cin is estimated by counting the number of the white dots and the number of black dots in a region, having a size which is determined according to the screen used this time, around one correction point, and calculating a ratio of the white dots and the black dots.

Figure 9:
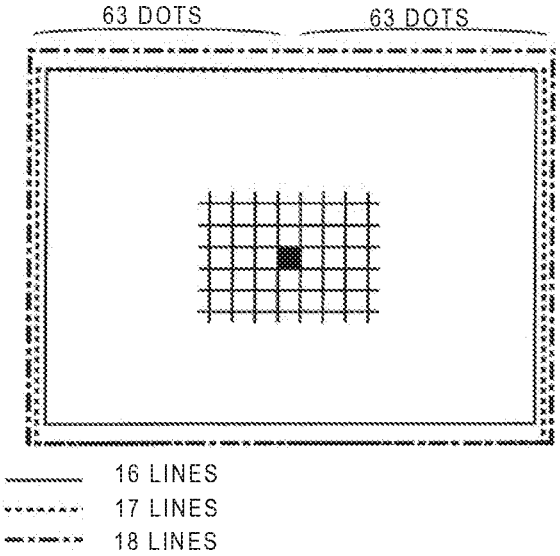
FIG. 9 is a diagram illustrating an image of a region that is determined according to a screen.

FIG. 9 is a diagram illustrating an image of the region determined according to the screen.

The region where the number of the white dots and the number of the black dots are counted for Cin estimation is switched according to the screen. For example, for a 212 lpi screen at a 45-degree screen angle that is used in general, when a lighting resolution is 2,400 dpi, a region of a multiple of 8 lines (here, 16 lines that is twice 8 lines) is selected.

This is based on the following calculation formulas. That is, a screen at a 45-degree screen angle has a repetition period of square root of 2 times, that is, about 1.4 times in a 0-degree direction. The 212 lpi screen at the 45-degree screen angle has the same repetition period in the 0-degree direction as a 300 lpi screen at a 0-degree screen angle. The term "212 lines per inch (lpi)" refers to 212 dots in 1 inch (≈25.4 mm). That is, dots of 0.12 mm (≈25.4 mm/212) are arranged. In a 300 lpi screen, dots of 0.085 mm (≈25.4 mm/300) are arranged. Herein, one dot of an image output at 2,400 dpi is 25.4/2400≈0.011 mm Therefore, the 300 lpi screen at the 0-degree screen angle repeats in a unit of (25.4 mm/300)/(25.4/2400)=8 dots. Then, for the 212 lpi screen at the 45-degree screen angle, 8×2=16 lines in the process direction are adopted as a region for Cin estimation. In the width direction, a wide 127-dot region is adopted. When a region having the same length in the process direction as that in the width direction is adopted, estimation errors of Cin decrease, but a huge memory capacity is required. Therefore, a region is set to be twice as large as the number of repeated dots.

For a 190 lpi screen at a 45-degree screen angle, a region having a multiple of 9 (here 9×2=18 lines) is similarly adopted. This region has 127 dots in the width direction.

A screen at a screen angle other than 0 degree or 45 degrees has no repetition period with a small number of dots in the 0-degree direction. Therefore, it is not necessary to pay particular attention to the number of repeated dots when determining the region.

In this way, the region where the number of the white dots and the black dots of the binary data is counted is set around each correction point, and the number of data representing the white dots and the number of data representing the black dots in the region are counted. For example, when a percentage of the white dots is 40% and a percentage of the black dots is 60%, it is estimated that Cin=60%. Further, for example, when the percentage of white dots is 80% and the percentage of the black dots is 20%, it is estimated that Cin=20%.

FIG. 10 is a diagram illustrating estimation errors of Cin relating to the types of the screen and the widths of the region in the process direction.

For the 212 lpi screen at the 45-degree screen angle, when the region of 16 lines is selected as in the calculation formula described above, the estimation errors of Cin are reduced compared to selecting a region of 17 lines or 18 lines.

Further, for a 190 lpi screen at a 45-degree screen angle, when the region of 18 lines is selected, the estimation errors of Cin are reduced compared to selecting the region of 16 lines or 17 lines.

A 205 lpi screen at a 20-degree screen angle or a 70-degree screen angle, and a 185 lpi screen at a 12-degree screen angle or a 67-degree screen angle have no repetition period with a small number of dots in the 0-degree direction. Therefore, the estimation errors of Cin are at the same level regardless of which region of 16 lines, 17 lines, or 18 lines is selected.

Herein, the example has been described in which information on the screen to be used this time is obtained and the region where the number of the white dots and the black dots are counted is set according to the screen. When the screen to be used is determined in advance and initialized, a region for the initialized screen may be always adopted.

In this way, when Cin is estimated in step S11 of FIG. 8, as described above, the correction magnification corresponding to the estimated Cin is calculated with reference to the correction magnification LUT 62 illustrated in FIG. 7 (step S12). Then, the light amount adjustment value is calculated with reference to the primary correction value table 61 illustrated in FIG. 6. The light amount of the exposure beam L emitted from the exposure unit 12 is adjusted according to the light amount adjustment value.

FIG. 11 is a block diagram illustrating a configuration of an exposure control device 50B according to the second exemplary embodiment of the present disclosure. Herein, description will focus on differences from the exposure control device 50A of the first exemplary embodiment illustrated in FIG. 3.

In the exposure control device 50A of the first exemplary embodiment illustrated in FIG. 3, the information on the screen and the binary data are input to the light amount controller 54, the region is set according to the screen, and Cin is estimated by counting the number of the white dots and the number of the black dots represented by the binary data in the region.

On the other hand, the exposure control device 50B of the second exemplary embodiment illustrated in FIG. 11 can obtain multi-level data representing Cin, and the multi-level data is input to the light amount controller 54. In the light amount controller 54, the input Cin is used (at step S11 in FIG. 8) as it is without performing the above Cin estimation, the correction magnification is calculated (at step S12 in FIG. 8), and then the light amount correction value is calculated (at step S13 in FIG. 8).

Similar to the exposure control device 50A of the first exemplary embodiment, the exposure control device 50B of the second exemplary embodiment adjusts the light amount of the exposure beam L emitted from the exposure unit 12 without adjusting the value of Cin on the data (for example, rewriting Cin=35 as Cin=38). Therefore, it is possible to adjust the light amount more finely than in Japanese Patent No. 5825862 in which the value of Cin is adjusted on the data.

The tandem image forming apparatus for forming a color image has been described as an example. It is noted that the present disclosure is applicable to a monochrome printer and the like.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An exposure control device comprising:

an exposure light amount calculator configured to obtain, for each of a plurality of correction points that are associated with a respective one of primary correction values and are separated from each other, a correction factor for correcting the primary correction value of the correction point, based on a pixel value of the correction point, calculate, for each correction point, a secondary correction value based on the primary correction value and the correction factor of the correction point, and calculate a distribution of the secondary correction values on an image based on the plurality of secondary correction values of the plurality of correction points; and an exposure controller configured to cause an exposure unit to form a latent image by exposure to light having a corrected light amount obtained by correcting a light amount corresponding to a pixel value of each point based on the secondary correction value of the point.

2. The exposure control device according to claim 1, wherein the primary correction values are correction values of the correction points that are calculated based on (i) read pixel values obtained by photoelectrically reading an image formed in advance and (ii) expected values.

3. The exposure control device according to claim 2, wherein the primary correction values are the correction values that are calculated based on (i) the read pixel values obtained by photoelectrically reading the image in which the expected values of the plurality of correction points are identical to each other and (ii) the expected values.

4. An image forming apparatus comprising:

the exposure control device according to claim 3, wherein an image is formed based on a binary screen latent image formed by the exposure unit.

5. An image forming apparatus comprising:

the exposure control device according to claim 2, wherein an image is formed based on a binary screen latent image formed by the exposure unit.

6. The exposure control device according to claim 1, further comprising:

a data converter configured to convert image data including a set of multi-level pixel data into binary data representing an image represented by binary screens, wherein the exposure light amount calculator calculates, for each of the plurality of correction points, the pixel value of the correction point based on the binary data around the correction point.

7. The exposure control device according to claim 6, wherein the exposure light amount calculator calculates, for each of at least a screen at a 0 degree screen angle and a screen at a 45-degree screen angle among the binary screens adopted in the data converter, the pixel value of each correction point based on the binary data in a region, around the correction point, having a size that is determined in advance according to a type of the binary screen.

8. An image forming apparatus comprising:

the exposure control device according to claim 7, wherein an image is formed based on a binary screen latent image formed by the exposure unit.

9. An image forming apparatus comprising:

the exposure control device according to claim 6, wherein an image is formed based on a binary screen latent image formed by the exposure unit.

10. The exposure control device according to claim 1, wherein the exposure light amount calculator obtains the correction factor of each correction point from the pixel value of the correction point with reference to a conversion table for converting the pixel value into the correction factor.

11. The exposure control device according to claim 10, wherein the conversion table is a monotonically increasing pattern table that monotonically increases with respect to the pixel value and is saturated with the correction factor in which the primary correction value and the secondary correction value are identical to each other when the pixel value is a predetermined value or more, and the primary correction values are correction values that are calculated based on (i) read pixel values obtained by forming an image consisting of pixel values in a range where the correction factors are saturated and photoelectrically reading the correction points on the formed image and (ii) expected values.

12. An image forming apparatus comprising:

the exposure control device according to claim 11, wherein an image is formed based on a binary screen latent image formed by the exposure unit.

13. An image forming apparatus comprising:

the exposure control device according to claim 10, wherein an image is formed based on a binary screen latent image formed by the exposure unit.

14. An image forming apparatus comprising:

the exposure control device according to claim 1, wherein an image is formed based on a binary screen latent image formed by the exposure unit.

15. The image forming apparatus according to claim 14, wherein the plurality of correction points are dispersed so as to spread in a range corresponding to one cycle of a rotating body that causes density nonuniformity.

16. A non-transitory computer readable medium storing a program that causes a computer to execute an exposure control process, the exposure control process comprising:

obtaining, for each of a plurality of correction points that are associated with a respective one of primary correction values and are separated from each other, a correction factor for correcting the primary correction value of the correction point based on a pixel value of the correction point;

calculating, for each correction point, a secondary correction value based on the primary correction value and the correction factor of the correction point;

calculating a distribution of the secondary correction values on an image based on the plurality of secondary correction values of the plurality of correction points; and forming a latent image by exposure to light having a corrected light amount obtained by correcting a light amount corresponding to a pixel value of each point based on the secondary correction value of the point.

* * * * *